US005110109A

United States Patent [19]

Stanco et al.

[11] Patent Number: 5,110,109

[45] Date of Patent: May 5, 1992

[54] ADJUSTABLE GRIPPER DEVICE FOR SHEET-FED ROTARY PRESSES

[75] Inventors: Christoph Stanco, Offenbach am Main; Heinrich Ochs, Sinntal; Kurt Difflipp, Dietzenbach, all of Fed. Rep. of Germany

[73] Assignee: MAN Roland Druckmaschinen AG, Fed. Rep. of Germany

[21] Appl. No.: 692,286

[22] Filed: Apr. 26, 1991

[30] Foreign Application Priority Data

Apr. 26, 1990 [DE] Fed. Rep. of Germany ..... 4013261

[51] Int. Cl.[5] ..... B65H 29/06

[52] U.S. Cl. ..... 271/82; 271/206; 271/277

[58] Field of Search ..... 271/82, 277, 206

[56] References Cited

U.S. PATENT DOCUMENTS 3,463,484 8/1969 Rudolph ..... 271/82
3,606,308 9/1971 Mowry ..... 271/277

FOREIGN PATENT DOCUMENTS 3015795 12/1980 Fed. Rep. of Germany .
278549A1 5/1990 Fed. Rep. of Germany .

*Primary Examiner*—Richard A. Schacher
*Attorney, Agent, or Firm*—Leydig, Voit & Mayer

[57] ABSTRACT

A gripper device for manually adjusting the position of a pair of gripper rows disposed on opposite sides of the periphery of double-size sheet-guiding cylinders, to a work and turn angle of exactly 180°. Each of the gripper rows includes a cam follower roller and at least one cam follower roller is adapted to have its center-line displaced relative to the axis of the gripper shaft so that the distance between the axes can be varied.

3 Claims, 3 Drawing Sheets

ADJUSTABLE GRIPPER DEVICE FOR SHEET-FED ROTARY PRESSES

FIELD OF THE INVENTION

The present invention relates generally to gripper devices in rotary presses and more particularly concerns a device for accurately controlling the grippers in such presses.

BACKGROUND OF THE INVENTION

A disadvantage of a sheet-guiding cylinder having two rows of grippers is that, because of manufacturing and assembly tolerances, the cam follower rollers, associated with each set of grippers, cannot be disposed apart from one another on the periphery of the sheet-guiding cylinder at a work and turn angle $\gamma$ of exactly 180° which is essential for the proper operation of half-revolution cylinders —— i.e., cylinders having two rows of grippers. Consequently, the grippers of one row or both rows open too early or too late. Errors in geometry of this kind upset the transfer of printed sheets in the correct register between consecutive printing cylinders.

OBJECT AND SUMMARY OF THE INVENTION

It is the primary object of the invention to provide a gripper device in which the position of the grippers on the periphery of the sheet-guiding cylinder can be accurately adjusted to a work and turn angle $\gamma$ of exactly 180°.

According to the present invention, an adjusting device is provided for manually adjusting the position of a pair of gripper rows disposed on opposite sides of the periphery of double-size sheet-guiding cylinders, to a work and turn angle of exactly 180°. Each of the gripper rows includes a cam follower roller and at least one cam follower roller is adapted to have its center-line displaced relative to the axis of the gripper shaft so that the distance between the axes can be varied.

The advantage of the invention is that the printed sheets can be transferred in correct register between consecutive printing cylinders since the peripheral position of the cam follower rollers on the periphery of the double-size sheet-guiding cylinders can be accurately adjusted to an angle $\gamma$ of exactly 180° or exactly one-half revolution.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
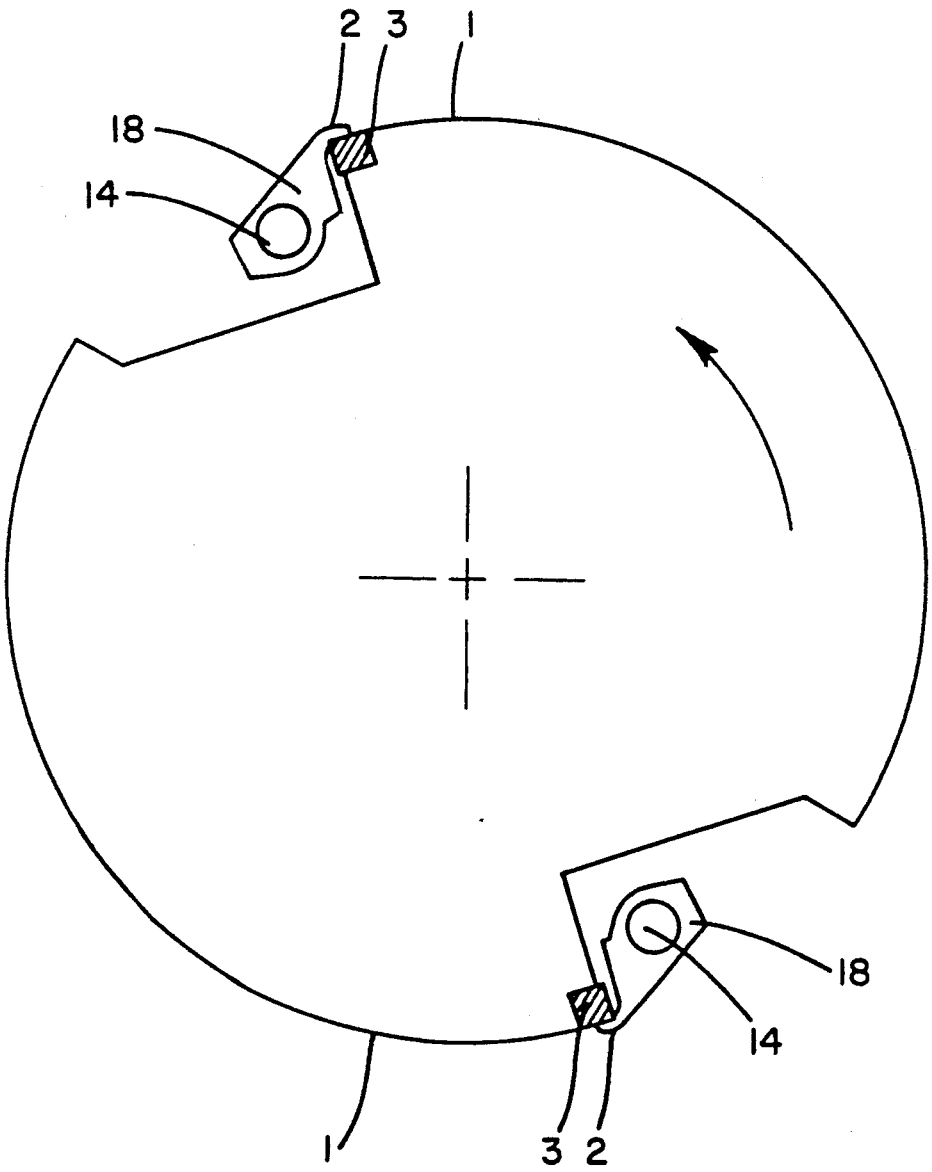
FIG. 1 is an end elevational view of a sheet-guiding cylinder without the gripper control according to the present invention.

Turning to the drawings, FIG. 1 shows a double size sheet-guiding cylinder 1 having two gripper rows which are disposed diametrically opposite one another. Each gripper row comprises a gripper shaft 14, a gripper holder 18, and a gripper finger 2. The gripper fingers 2 are secured to the shafts 14 by means of the gripper holders 18.

The cylinder 1 holds a sheet between the gripper finger 2 and the gripper pad 3. Transfer of the sheet from the double-size sheet-guiding cylinder 1 to an immediately consecutive sheet-guiding cylinder (not shown) is effected at the point of tangency of the two adjacent cylinders, such point lying on the line interconnecting the cylinder axes. For accurate sheet transfer, the sheet must be retained on the cylinder 1 at a predetermined position and angle, known as the synchronism position, for engagement jointly by the opening and closing gripper systems of the adjacent cylinders.

Figure 2:
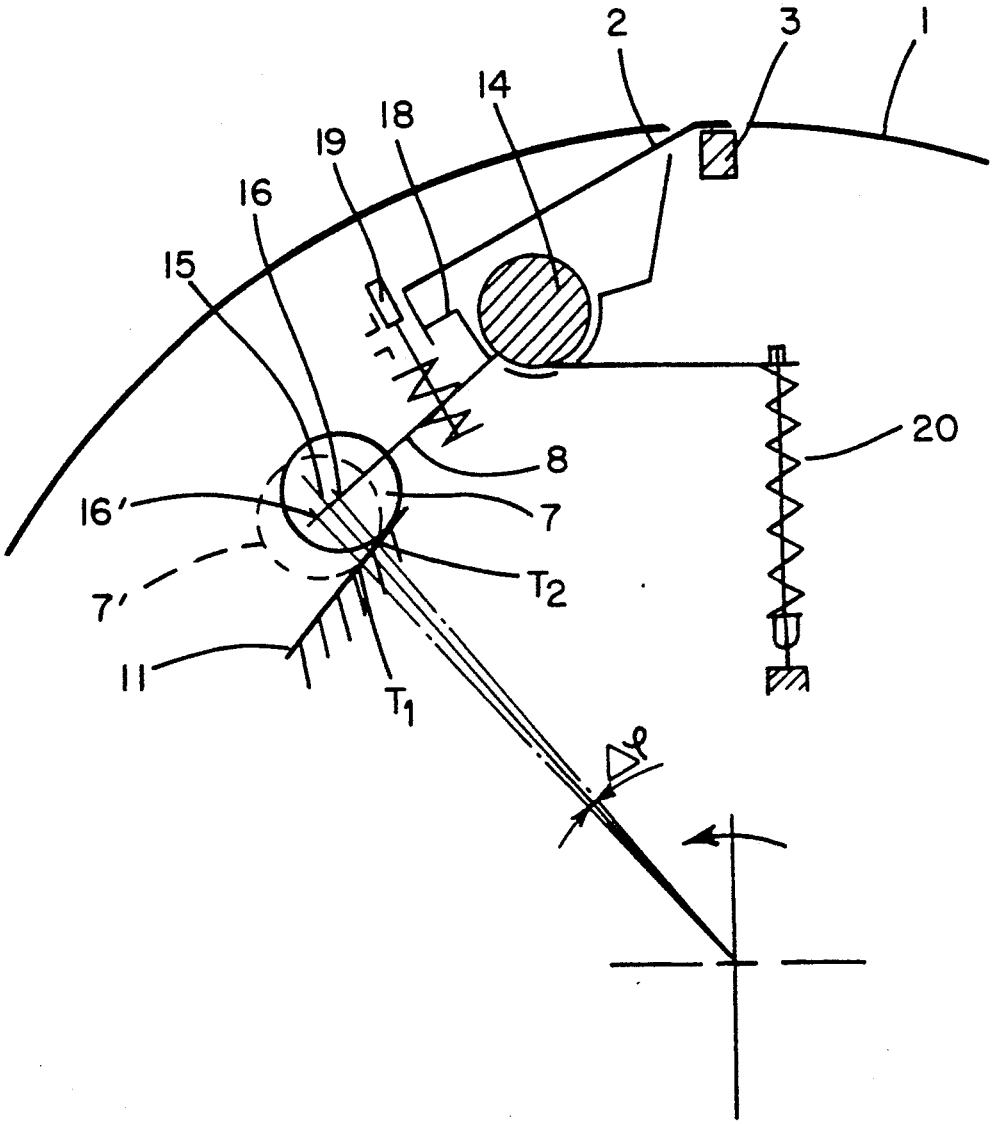
FIG. 2 is a schematic representation of the gripper control of the first row of grippers of the sheet-guiding cylinder of FIG. 1.

FIG. 2 shows the gripper control for one of the two gripper rows located on the periphery of the cylinder 1. The gripper shaft 14 is rockably mounted on the cylinder 1 so that the gripper can engage and hold a sheet between the gripper finger 2 and the gripper pad 3. The cylinder 1 is twice the size of the plate cylinder (not shown). A gripper spring 19 acting on the gripper shaft 14 causes the gripper, consisting of the holder 18 and finger 2, to firmly but non-positively engage the gripper pad 3 across the width of the cylinder 1. The grippers are conventional and do not form part of the invention.

The grippers are controlled by a cam actuator comprising a cam follower roller 7, a cam follower lever 8 and a stationary or unitary cam 11. Each lever 8 is rigidly disposed on the associated gripper shaft 14. A compression spring 20 acting on the lever 8 maintains contact between the cam follower rollers 7 and the cam 11. The cam actuator enables the camming pattern of the cam 11 to be transmitted directly to the fingers 2 of the two gripper rows.

In accordance with the present invention, means are provided to manually adjust the peripheral positions of the two cam follower rollers 7 relative to one another to obtain a work and turn angle $\gamma$ of exactly 180°. In carrying out the invention, at least one cam follower roller 7 is provided whose center-line 16 can be displaced relative to the axis of the gripper shaft 14.

As shown schematically in FIG. 2, the peripheral position of the cam follower rollers 7 relative to one another can be adjusted over a range $\Delta\gamma$. Thus the cam follower roller 7 can be adjusted from its position T1 to a position T2. At position T1, the position of the cam follower roller 7' and its associated center line 16' is shown in phantom.

Figure 3:
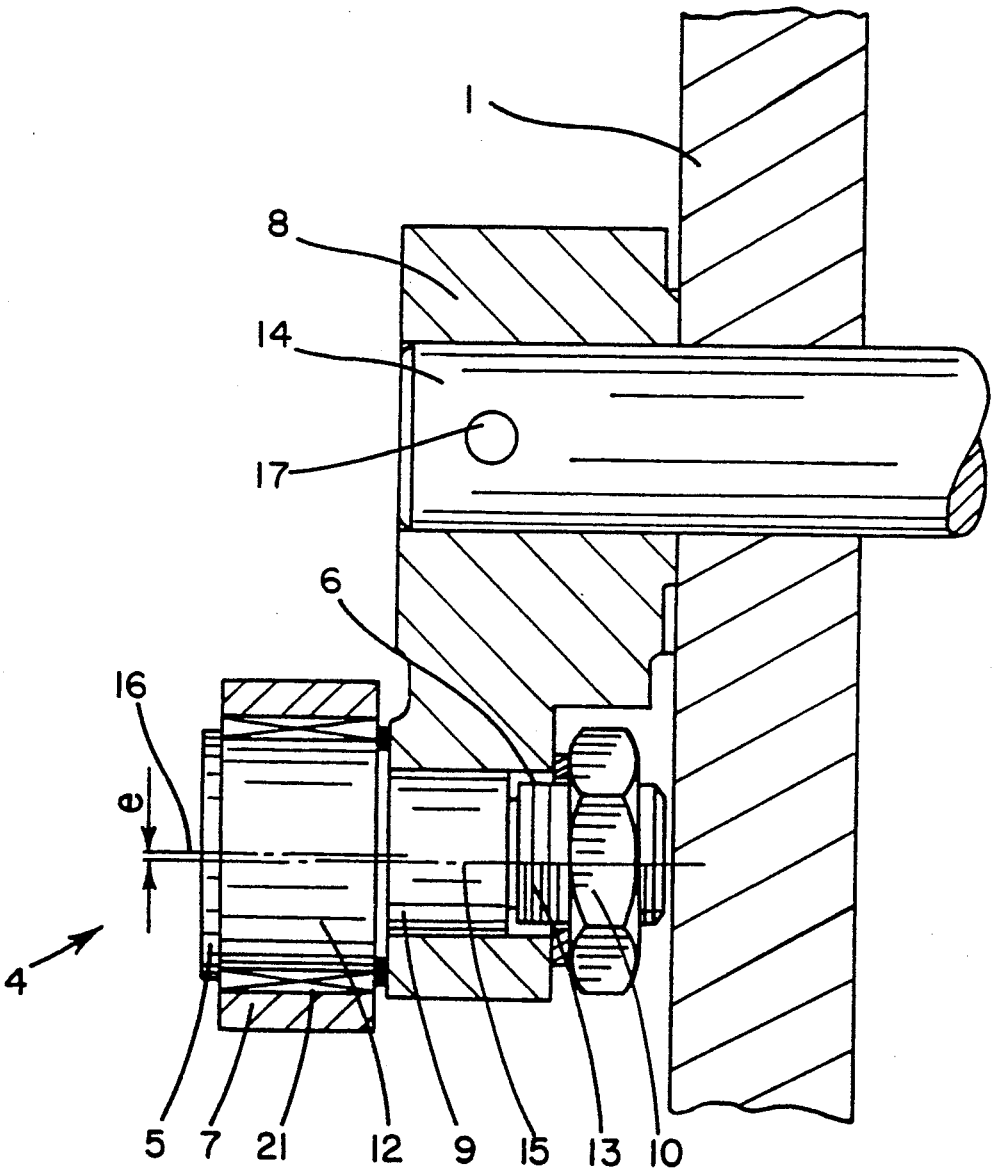
FIG. 3 is an enlarged, fragmentary cross-sectional view of the cam follower roller adjuster.

Pursuant to the invention and as more particularly shown in FIG. 3, the lever 8, associated with the cam follower roller 7, has a bearing bore 6 which receives an adjuster 4. Preferably, the adjuster 4 comprises a stepped bearing pin 5 having an eccentric stem 12 at its first end and a coaxial stem 9 at its second end. The cam follower roller 7 is rotatably attached to the eccentric stem 12. The coaxial stem 9 is adapted to engage the bearing bore 6 and has a fine screwthread 13 for receiving a locknut 10 to secure the adjuster in position.

When the eccentric stem 12 of the pin 5 is rotated, the center-line 16 of the cam follower roller 7 moves around the center-line 15 of the bore 6 through $\Delta\gamma$ from T2 to T1 so that the axial separation between the centerline 16 of the cam follower roller 7 and the fixed pivoting axis of the gripper shaft 14, is varied. The eccentricity e must be small, for example, about 0.5 mm, in order to prevent increasing the opening width of the grippers of one gripper row relative to the other gripper row since the distance between the centerline 16 and the axis of the cylinder 1 and, therefore, the pivoting position of the gripper shaft 14, are also varied somewhat. After the position of the pin 5 is adjusted, its position can be secured by means of the locknut 10, which presses the pin 5 into firm engagement with the end face of the lever 8.

As will be apparent from FIG. 3, the cam follower 7 is fixed to the eccentric stem 12 of the pin 5 by bearings 21. It will also be understood that the lever 8 is rigidly connected to the griper shaft 14 by suitable means such as a pin 17.

Displacement of the cam follower roller 7 is not limited to the illustrated embodiment having the eccentric adjustment as described above, but can be achieved by a displaceable mounting of a pin 5 in the lever 8 and a corresponding adjusting facility. Alternatively, an eccentric or displaceable mounting for the lever 8 on the gripper shaft 14 can be provided, if desired.

We claim as our invention:

1. An adjustable gripper device for use in a sheet-guiding cylinder having two gripper rows located diametrically opposite one another on the periphery of the cylinder which is rotatable relative to a stationary cam defining a predetermined camming pattern, each of said gripper rows including a cam driven gripper shaft for holding gripper fingers rockably mounted on the cylinder, a cam follower lever having one end rigidly connected to the gripper shaft, a cam follower roller rotatably attached to the other end of the cam follower lever, means for maintaining contact between the cam follower roller and the stationary cam so that the camming pattern can be transmitted to the fingers, and said adjustable gripper device comprising means for adjusting the center line of the cam follower roller on at least one side of the cylinder relative to the axis of the gripper shaft so that the peripheral position of the one cam follower roller relative to the other cam follower roller on the opposite side of the cylinder is at a work and turn angle $\gamma$ of exactly 180°.

2. A gripper device according to claim 1 wherein the adjusting means includes an eccentric pin for mounting the one cam follower roller on the other end of the cam follower lever on the one side of the cylinder.

3. A gripper device according to claim 2 wherein the other end of the cam follower lever includes a bore, the eccentric pin includes first and second ends, the second end of the pin having a coaxial stem received in the bore and a screwthread which engages a locknut in order to axially clamp the pin to the cam follower lever, the first end of the pin having an eccentric stem with eccentricity e, and the one cam follower roller being rotatably attached to the eccentric stem.

* * * * *